US008099929B2

(12) United States Patent
Kirby et al.

(10) Patent No.: US 8,099,929 B2
(45) Date of Patent: Jan. 24, 2012

(54) PRODUCT FEEDING APPARATUS

(75) Inventors: Raymond George Kirby, Bournemouth (GB); Kim Warrick, Reading (GB)

(73) Assignee: Surgichem Limited, Leeds (GB)

( * ) Notice: Subject to any disclaimer, the term of this patent is extended or adjusted under 35 U.S.C. 154(b) by 0 days.

(21) Appl. No.: 12/677,843

(22) PCT Filed: Sep. 15, 2008

(86) PCT No.: PCT/GB2008/003133
§ 371 (c)(1),
(2), (4) Date: Sep. 30, 2010

(87) PCT Pub. No.: WO2009/034636
PCT Pub. Date: Mar. 19, 2009

(65) Prior Publication Data

US 2011/0011882 A1 Jan. 20, 2011

(30) Foreign Application Priority Data

Sep. 14, 2007 (GB) ..... 0717980.7

(51) Int. Cl.
*B65B 5/10* (2006.01)
*A47F 1/04* (2006.01)

(52) U.S. Cl. ..... 53/244; 53/235; 53/249; 53/475; 221/68; 221/304

(58) Field of Classification Search ..... 53/473, 53/475, 235, 244, 248, 249, 237, 239; 221/304, 221/68, 156, 171, 296
See application file for complete search history.

(56) References Cited

U.S. PATENT DOCUMENTS 2,656,962 A 10/1953 Daniels
2,786,566 A * 3/1957 Taggart et al. ..... 221/168
3,417,542 A 12/1968 Merrill et al.

(Continued)

FOREIGN PATENT DOCUMENTS

GB 727237 3/1955

OTHER PUBLICATIONS

International Search Report for PCT/GB2008/003133.

*Primary Examiner* — Paul Durand
(74) *Attorney, Agent, or Firm* — Caesar, Rivise, Bernstein, Cohen & Pokotilow, Ltd.

(57) ABSTRACT

Automatic feeding machines are commonly used for filling blister packs with items of product such as pharmaceutical dosage forms. These machines are usually designed for the handling of a specific shape and sized product item. Handling of different shaped items requires expensive re-tooling of all the product item contact components. The invention allows a single feeding machine to be quickly configured for use to handling a wide variety of item sizes/shapes. A machine (21) has a tray (36) defining a series of tapered channels (40) and a container (22) slideably mounted above the tray. A wall of the container and the channels together define apertures into each channel through which items of product pass out of the container. Sliding movement of the container across the planar tray surface (38), along and over the channels, allows the size of the apertures to be adjusted depending upon the size of the item of product to be handled, using the same components.

30 Claims, 18 Drawing Sheets

U.S. PATENT DOCUMENTS 3,645,069 A * 2/1972 Waite ..... 53/542
4,046,285 A * 9/1977 Wendt ..... 221/157
4,265,072 A * 5/1981 Egli ..... 53/501
4,674,259 A * 6/1987 Hills ..... 53/202
4,677,283 A * 6/1987 Lewis ..... 235/98 C
4,953,343 A * 9/1990 Hellman ..... 53/500
5,110,008 A * 5/1992 Moulding et al. ..... 221/259
5,219,093 A * 6/1993 Moulding et al. ..... 221/259
5,348,061 A * 9/1994 Riley et al. ..... 141/104
5,463,839 A * 11/1995 Stange et al. ..... 53/54
5,587,572 A * 12/1996 Kirby ..... 235/98 R
6,631,799 B2 * 10/2003 Samson ..... 198/771
6,899,144 B1 * 5/2005 Geltser et al. ..... 141/2
7,066,350 B2 * 6/2006 Aylward ..... 221/232

* cited by examiner

PRODUCT FEEDING APPARATUS

CROSS-REFERENCE TO RELATED APPLICATIONS

This national stage application claims the benefit under 35 U.S.C. §371 of International Application No. PCT/GB008/003133 filed on Sep. 15, 2008, entitled PRODUCT FEEDING APPARATUS, which in turn takes its priority from British Application No. 0717980.7 filed on Sep. 14, 2007 and all of whose entire disclosures are incorporated by reference herein.

BACKGROUND

The present invention relates to product feeding apparatus suitable for delivering items of product into pockets of a blister type pack and, in particular but not exclusively, for the feeding of pharmaceutical dosage forms into pockets of pharmaceutical blister and patient packs.

Patient packs are trays defining an array of pockets for holding medication for a patient, hermetically sealed by a film. Typically the pockets, which are sized to accommodate a variety of product types, hold a dose of medication to be taken on a particular day or time. For example, a pack may have an array of pockets arranged into four columns by seven rows wherein each column represents one week of a four week period and the rows represent days within each week. If medication is needed to be taken multiple times a day, e.g. with breakfast, lunch and dinner, three packs would be assigned to the patient for the four week period wherein each pack contains the medication for the respective dose for breakfast, lunch and dinner.

Patient packs are particularly useful in environments such as nursing homes and prisons for the dispensing of medication to residences with ongoing or repeat prescriptions. The prescription, in the form of tablets, capsules, caplets or other discrete dosage forms, is made up in advance at a pharmacy, hand filled into the pockets of the patient pack, sealed, marked with the patient's details and sent to the patient's residence. The medication can then be taken by the patient as directed on the pack. This system obviates the need for institutions, such as those mentioned above, to employ staff who are authorised to dispense medication.

Automatic filler machines are commonly used for the filling of specific product items into blister packs. The process for each product is heavily tailored with the blister pack and filling machining being specifically designed to hold and handle the dimensions and form of the particular product item. Modification of the machines to handle a different shaped or sized product requires expensive re-tooling of all the product contact components. It is thought that in excess of 300 sets of re-tooled components would be needed for a feeding machine to handle all of the known discrete dosage forms of pharmaceutical product.

As a consequence of the above, automatic feeders have been considered impractical for use in filling patient packs where a wide variety of different product forms are handled, often in relatively small quantities at a time.

SUMMARY OF THE INVENTION

In accordance with one aspect of the present invention, there is provided product feeding apparatus for delivering items of product to one or more outlets from which they may be delivered into pockets of a blister type pack or other packaging or receptacle, comprising:

a surface defining one or more channels arranged to guide items of product and where the width and/or depth of the channel increases towards an exit of the channel;

a wall adjacent to the surface;

wherein the wall and one or more channels cooperate to define at least one aperture through which items of product pass towards the exit of the channel;

and wherein the size of the aperture is adjustable by movement of the wall and/or surface relative to the other.

The invention enables a single feeding machine to be used to fill a package such as a blister pack with product items having a variety of product forms, such as tablets, caplets, capsules, hardgels and softgels in a wide range of sizes and shapes, without the need for numerous expensive sets of tooled components A preferable embodiment of the invention comprises a repository for holding loose items of product. The wall may be associated with the repository or more favourably form part of the repository. Ideally, the wall is arranged to move transversely across the surface which may be achieved by slideably mounting the repository above the surface. If the wall is moved along the channel in a direction of increasing or decreasing channel width or depth, the aperture size may be correspondingly increased or decreased using the same set of components.

It is preferred that the channels of the surface be tapered over at least a part of their length. It is preferred that the channels be sloping downwardly from the horizontal over at least a part of their length. It is preferred that the surface be agitated by vibrating means so as to shake items of product along the channels towards their exits.

Movement of the items of product out of a channel before the intended exit point may be prevented by a restraining means which preferably takes the form of a restraining member supported above the open channel. The restraining member may be supported such as to be inclined at an angle relative to the surface. This angle may correspond to the slope of the channel, or may be steeper, thus causing the channel depth to decrease towards its exit.

The apparatus may also comprise a discharge gate mechanism associated with each channel to control delivery of items of product from the channel exit into pockets of the blister pack or other receptacle. It is preferred that the gate mechanism comprises at least two sequential gates defining a product item delivery compartment between them. At least one of the gates, particularly an entry gate to the delivery compartment, may be associated with a restraining member. It is further preferred that a gate associated with a restraining member is formed as a lip on the restraining member which protrudes into the channel. The gate may be actuated by making the restraining member moveable relative to the channel. Alternatively, the gates may be separate from the restraining members.

So as to control the number of items of product being retained in the delivery compartment between the two gates at one time, it is preferred that the gate mechanisms of the sequential gates for each channel are operable independently from one another, that at least the delivery compartment entry gate mechanisms for separate channels are operable independently from one another, and that the spacing between the gates is adjustable to control the size of the compartment.

To aid in limiting or controlling the flow of items of product, the repository may further comprises a baffle. Product sweeping means may be provided to sweep product items over the surface containing the channels, in order to limit build-up of product on the surface. Such sweeping means may be provided before the at least one aperture, preferably adjacent the wall and inside the repository.

It is further preferred that the repository, restraining means and gate mechanism are supported on one or more carriages so as to be slideably moveable. The carriages may be moveable along rails, and provided with clamps and position indicators so that their positions for particular product items may be reproduced.

Other aspects of the invention are set out in the following specific description and in the claims.

BRIEF DESCRIPTION OF THE DRAWINGS

Two embodiments of the invention will now be described by way of example and with reference to the following figures in which.

DETAILED DESCRIPTION OF PREFERRED EMBODIMENTS

Figure 1:
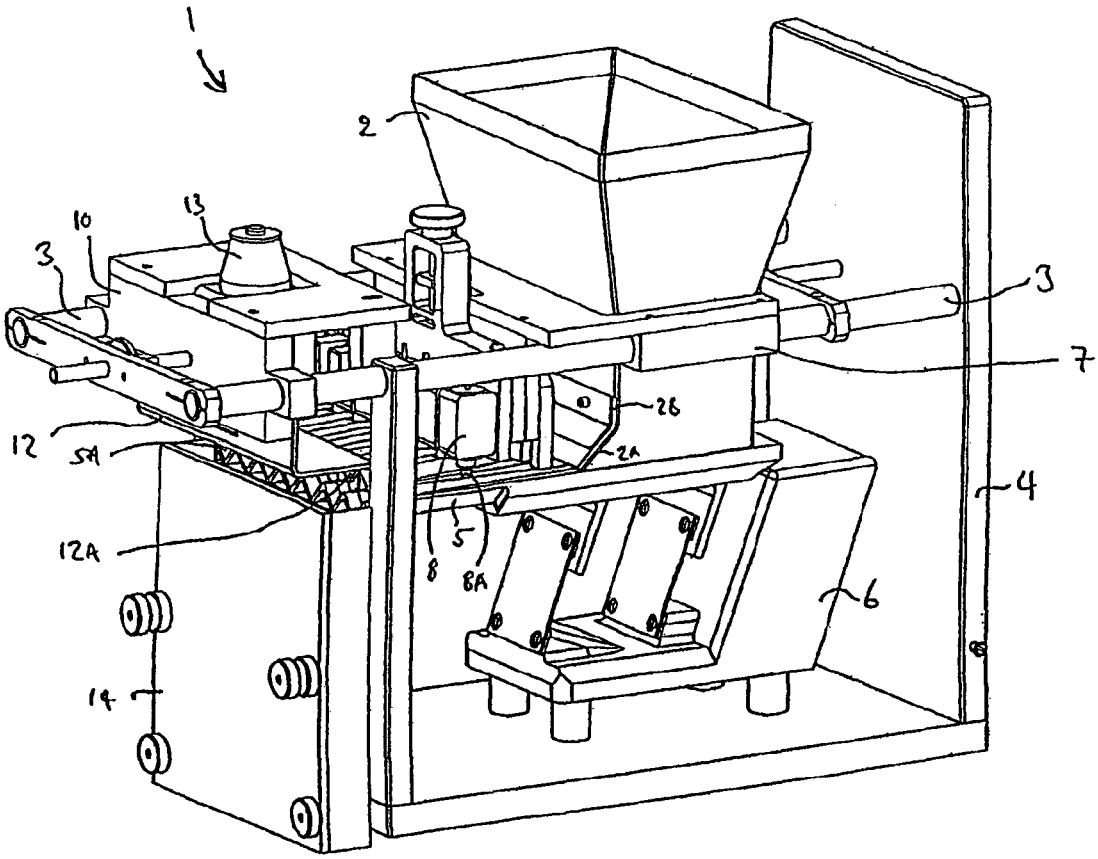
FIG. 1 is an isometric view of a first embodiment of a filling machine for filling discrete items of pharmaceutical product into patient packs.
Figure 2:
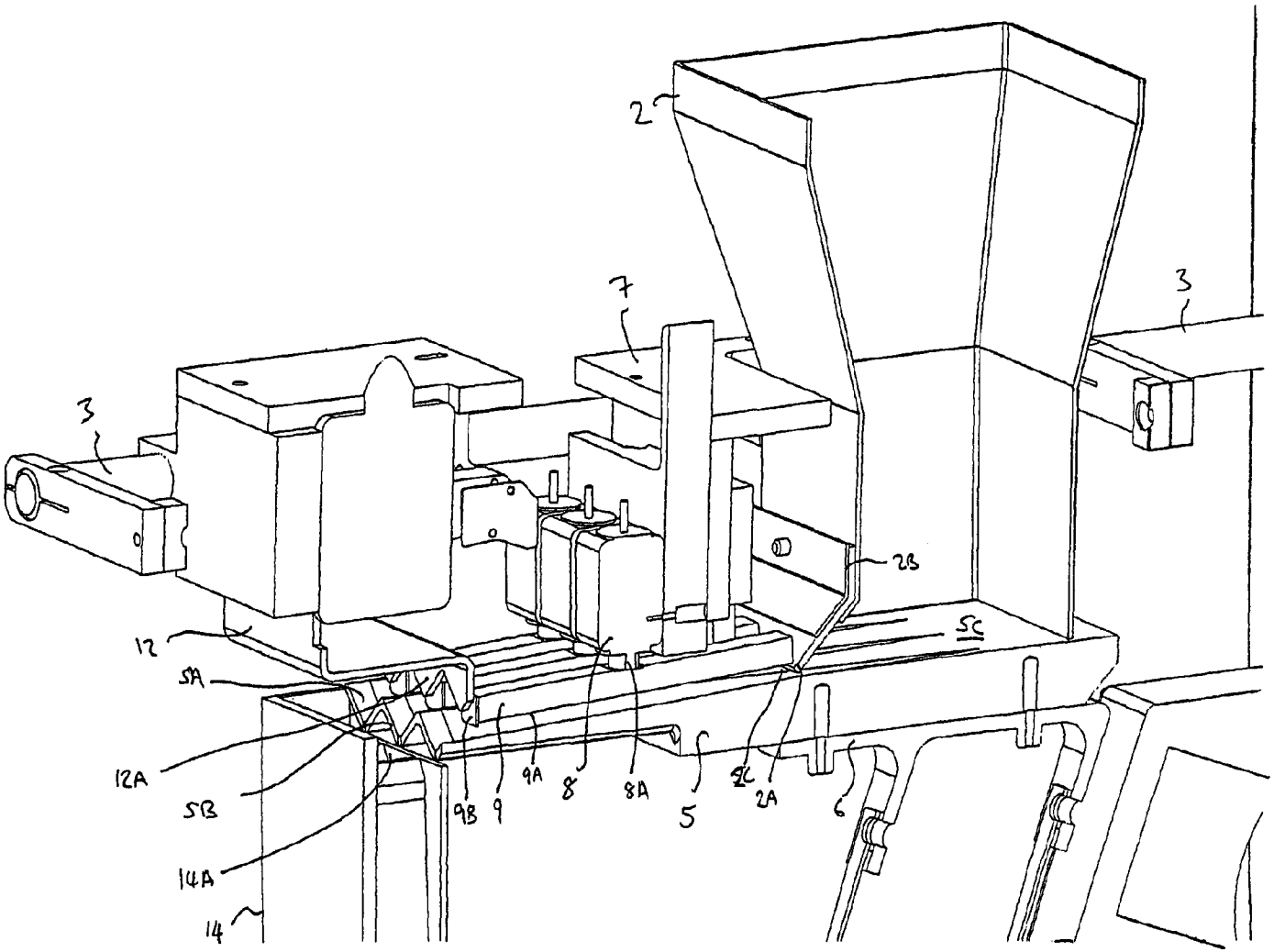
FIG. 2 is an enlarged isometric view of the hopper (repository) and tray (surface) of FIG. 1 in cross section.
Figure 3:
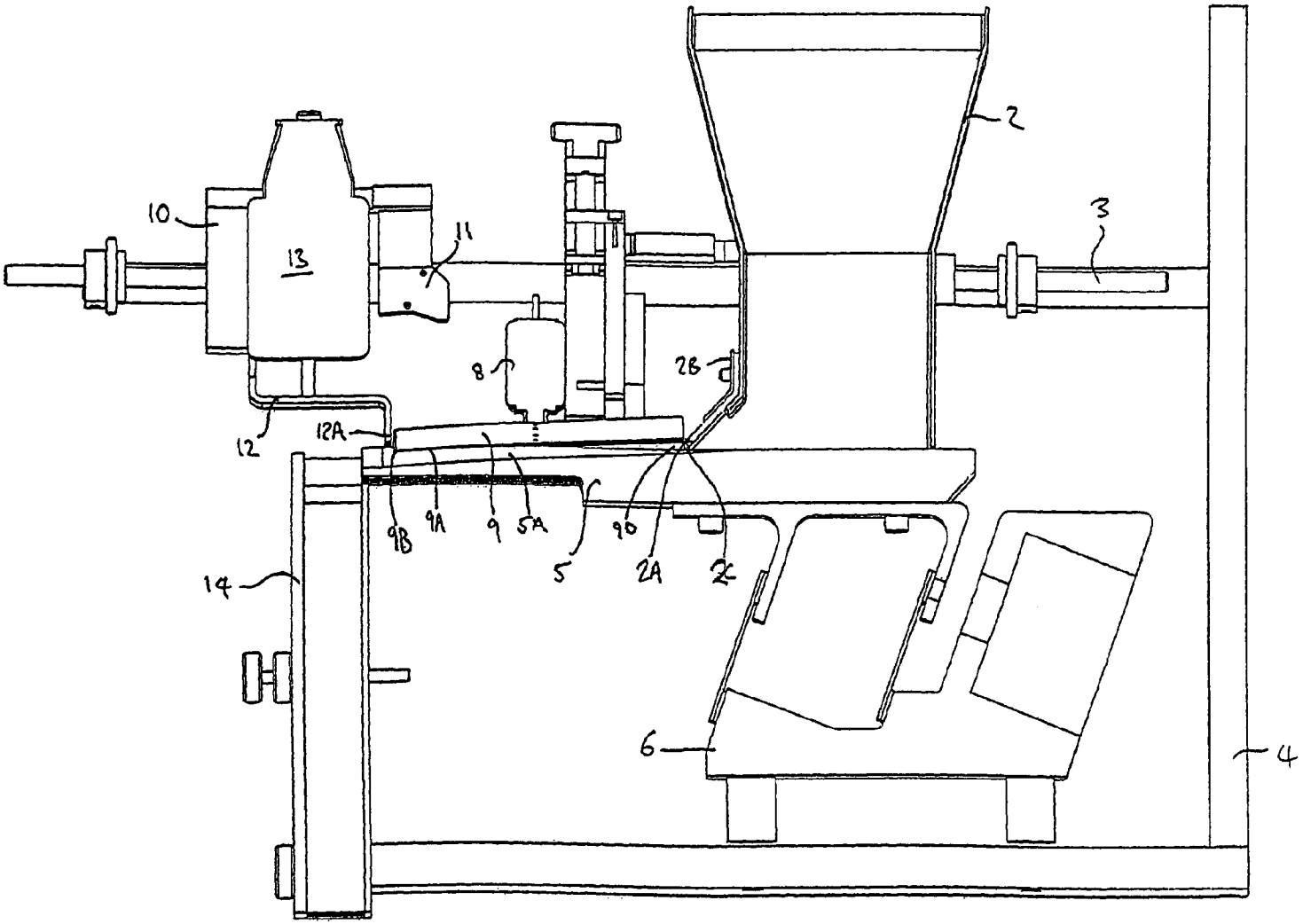
FIG. 3 is a side view cross section of the filling machine.

Referring to FIGS. 1 to 3 there is shown a filling machine 1 comprising a repository for discrete items of pharmaceutical product, formed of an inverted truncated pyramid shaped hopper 2. The hopper 2 has an open bottom and a lower portion of its front wall is formed from a rubber strip member 2A secured by clamp 2B. The hopper 2 is slideably supported via a carriage 7 on slide rails 3 which are in turn supported on a frame 4.

A product feed tray 5 has a top surface which defines seven parallel open-topped channels 5A running to an edge (discharge end) 5B of the tray substantially along the length of the tray 5. The channels 5A have a V-shaped, including flat bottom V-shaped, cross section. The width and depth of each channel 5A tapers gradually along its length from a width and depth of zero in a hopper base region 5C of the top surface of the tray 5 to a maximum width and depth, and is thereafter constant to an exit end of the tray from which product will, in use, be discharged. Throughout the channel's length, its width W is greater than its depth D so as to minimise jamming of an item of product in the channel 5A. The bottoms of the channels slope at a shallow angle, typically up to ten degrees and preferably from four to eight degrees to the horizontal, downwardly towards the exit end.

The tray 5 is positioned such that the hopper base region 5C is directly below the hopper 2 so as to form a base of the hopper 2. The tray 5 is also orientated such that the channels 5A extend under the front wall 2A of the hopper 2 forming seven apertures 2C defined between the channel 5A walls and the bottom edge of the front wall 2A. The tray 5 is supported by an electromagnetic shaker 6, of a kind known as a vibrating means in the blister pack filling art. The shaker 6 is itself mounted on frame 4.

Figure 4A:
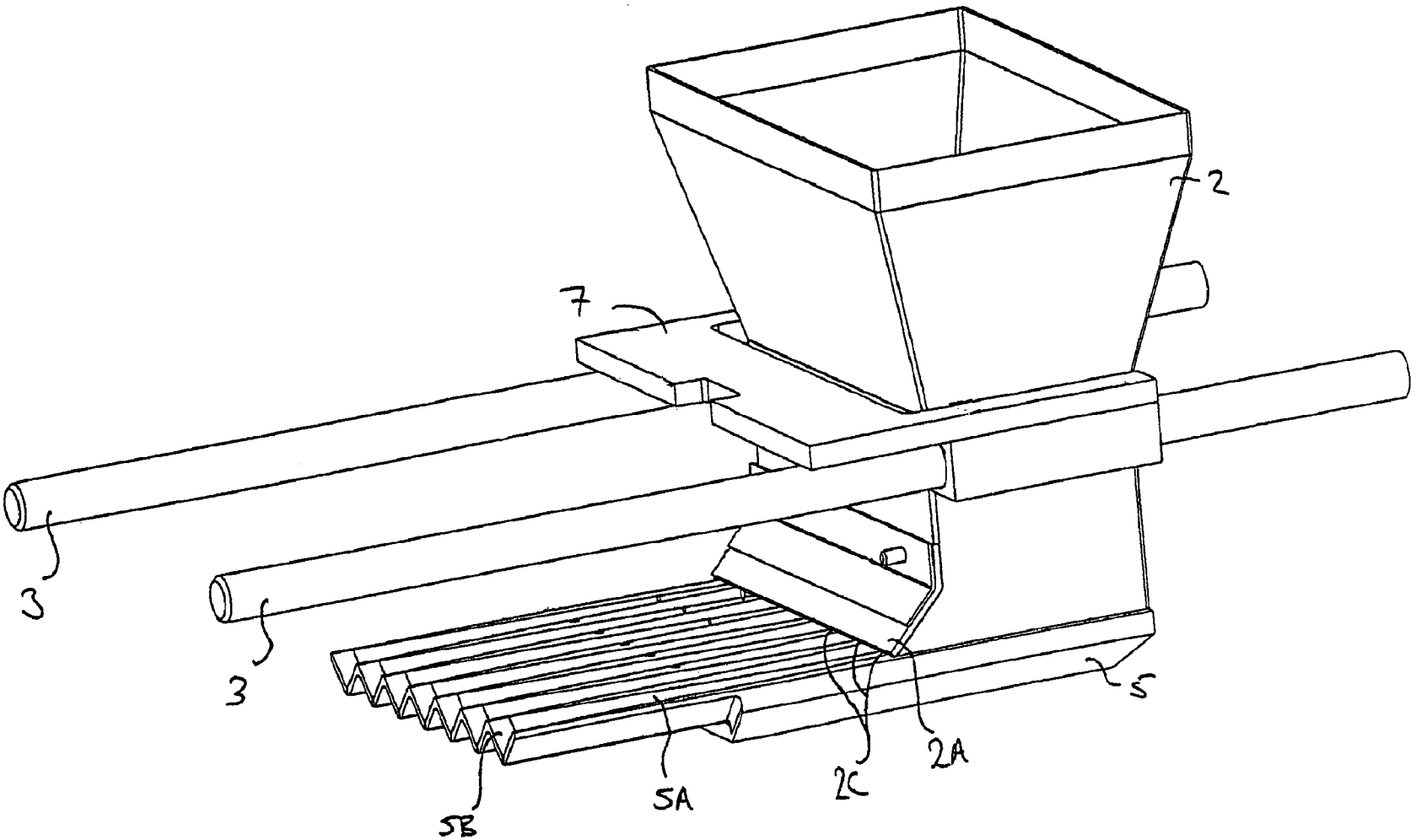
FIGS. 4A and 4B are isometric views to illustrate movement of the hopper across the tray to adjust the aperture size.
Figure 4B:
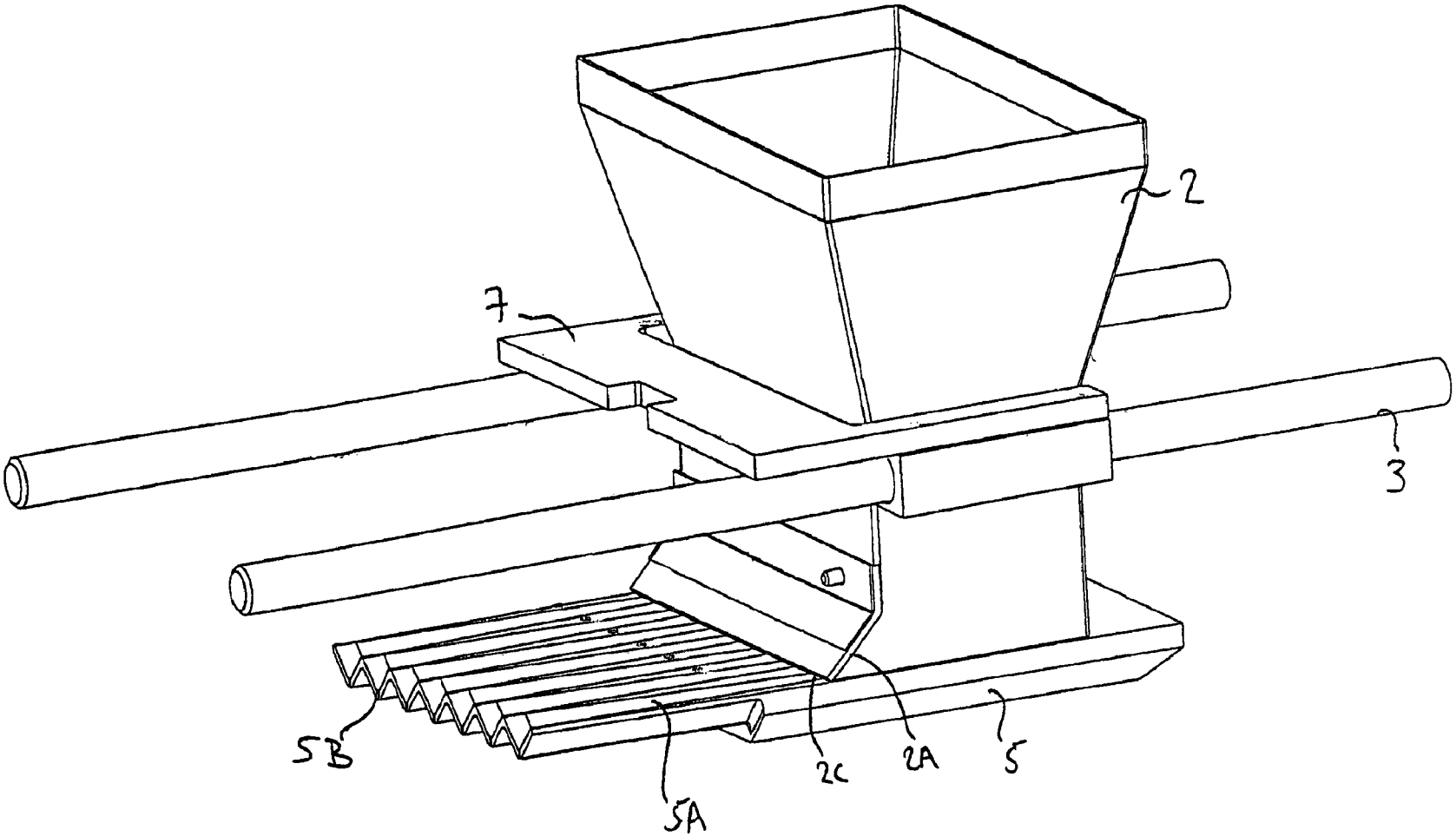

As can be seen in FIGS. 4A and 4B, the carriage 7 enables the hopper 2 to be slid along slide rails 3, horizontally across the top surface of the tray 5, parallel with the channels 5A. Movement of the hopper 2 towards the discharge end 5B of the tray 5 causes the aperture size 2C to increase as a consequence of the enlarging width W and depth D of channel 5A. Conversely, movement away from the discharge end 5B of the tray 5 causes a reduction in the aperture 2C size. Movement of this kind allows the apertures 2C to be sized depending upon the product held within the hopper 2, such as to allow only a single item of product to pass out of each aperture of the hopper at a time, according to the product item dimensions.

Also mounted onto carriage 7 in front of wall 2A is a restraining mechanism comprising seven solenoid linear actuators 8, actuating rods 8A and restraining bars 9. The restraining bars 9 are supported directly above the centreline of each channel 5A and inclined at an angle so that the lower surface 9A of each retaining bar is closest to the tray 5 at the discharge end. Formed at the free end of each bar 9 is a lip 9B which protrudes into the channel 5A. The lip 9A acts as a gate for the control of items of product along each channel 5A. Each lip/gate 9B may be raised or lowered independently of the other six gates 9B.

Because the restraining mechanism and hopper 2 are mounted on the same carriage 7, both can be moved across the tray 5 whilst maintaining the horizontal relationship between the apertures 2C and restraining bar inlets 9D.

Slide rails 3 also support a second carriage 10 independently moveable from the first carriage 7, onto which is mounted a laser sensor 11 associated with each channel 5A, a discharge gate 12 and a solenoid operated linear actuator 13.

Laser sensors 11 are arranged to detect the presence of an item between the gates 9B and 12. Each sensor has a complementary reflector which is formed from a polished base portion of the V-shaped channel. The sensors 11 and solenoid actuators are controlled by a programmable logic control system also not shown.

The discharge gate 12 is composed of a machined plate defining seven protrusions 12A and arranged so that each protrusion sits within a channel 5A at the discharge end 5B of the tray 5. The protrusions 12A may be raised and lowered in unison by the solenoid actuator 13 to control the discharge of items of product from the tray 5.

Supported by the frame at the discharge end of the tray 5 is a vertical delivery box 14 containing seven individual chutes whose inlets are aligned with each of the channels 5A. The width and depth of each chute at its outlet end is equal to the width and depth of a patient pack pocket (not shown) which are positioned at the outlet end of the chutes 14A for filling.

The feeder machine 1 is enclosed within a clear polycarbonate cover (not shown) secured with quick release fasteners to the main frame.

Before operation, the carriage 7 holding hopper 2 and the restraining mechanism are slid along slide rails 3 so as to tailor the aperture size 2C to the size/shape of the product item. The height of the restraining bars 9 above the channel may also be adjusted to ensure that the product items do not climb above one another when queued along the channel and so as to ensure that gate 9B operates effectively.

The second carriage 10 may also be slid along rails 3 so as to ensure that the discharge gate 12 and lip 9B are separated by a distance corresponding to the size of a single item of product, thus forming a delivery compartment.

In use, loose items of product are fed into the top of hopper 2 and retained between the walls of the hopper 2 and tray 5. The electromagnetic shaker 6 agitates the tray 5 to incite the items of product to move generally down the slope towards the discharge end of the tray. Rubber wall 2A generally prevents the passage of items of product out of the hopper 2. However, items which have fallen within the channels 5A are able to pass out through apertures 2C one at a time.

The items move along the channels until they reach lip 9B. Restraining bar 9 ensures that the queue of items of product along the channel between gate 9B and aperture 2C remain in single file by preventing 'climbing' of the items on top of one another.

Upon a command from the control system the solenoid actuator 8 raises lip 9B to allow passage of an item through into the delivery compartment. The distance between the discharge gate 12A and lip 9B has been pre-set so that only a single item of product can reside between the two at a time. The presence of an item between the gates 12A and 9B is sensed by sensor 11 which causes the actuator 8 to lower the lip 9B to prevent any further items from entering the gate.

Once an item of product is contained between each of the pairs of gates, the control system instructs the discharge gate 12B to be raised by actuator 13 allowing the discharge of the seven items from the tray and down chutes 14A into the patient pack (not shown) which is positioned at its outlet.

The ability of the of the individual gates 9B to open and close independently of one another enables the feeder 1 to accommodate for varying passage rates of items of product along individual channels 5A. This reduces the possibility of more than one item of product collecting in the delivery compartment between the gates 9B and 12 at one time.

Upon discharge of the items from the tray 5, the discharge gate 12 is closed and the lips 9B are again raised to allow the passage of seven further items into the delivery compartments between the gates 9B, 12.

Figure 5A:
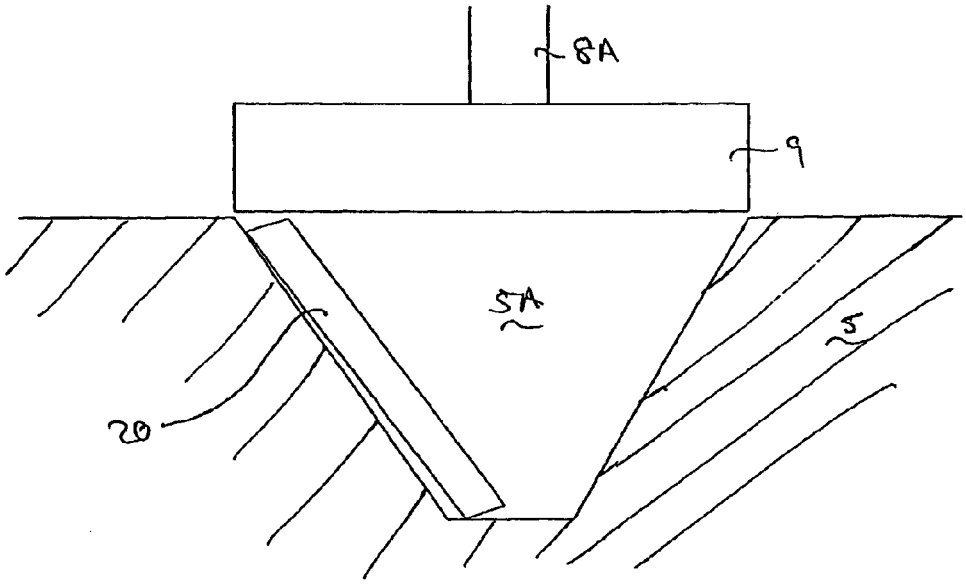
FIGS. 5A and 5B are cross section views of a tray in conjunction with preferred profiled restraining bars.
Figure 5B:
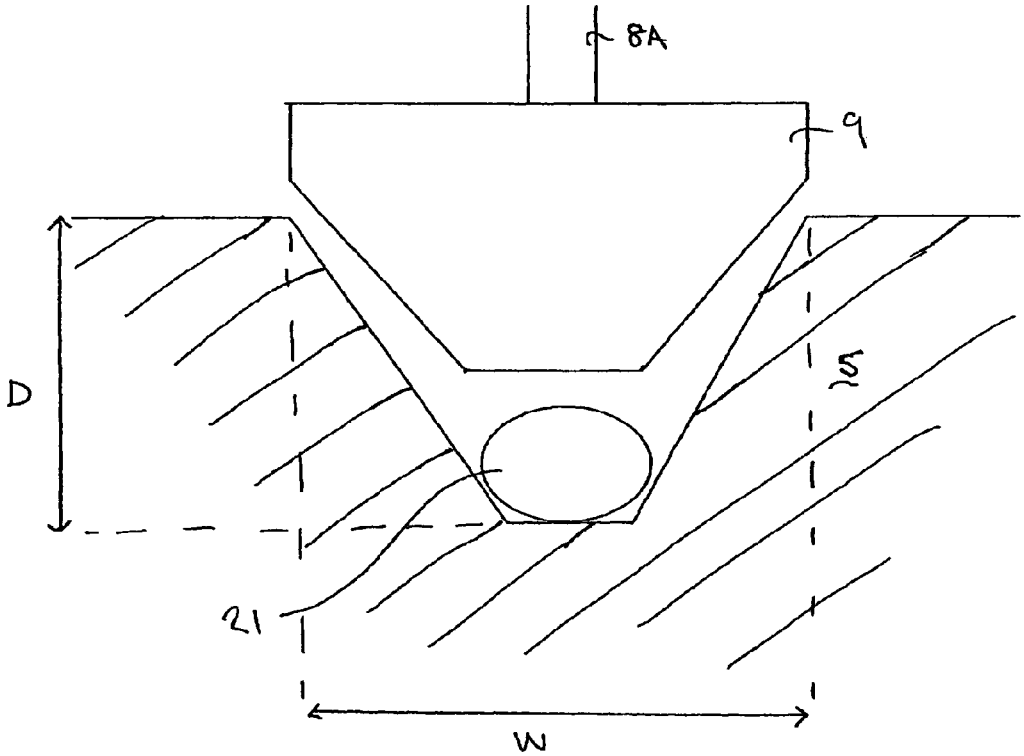
Figure 6:
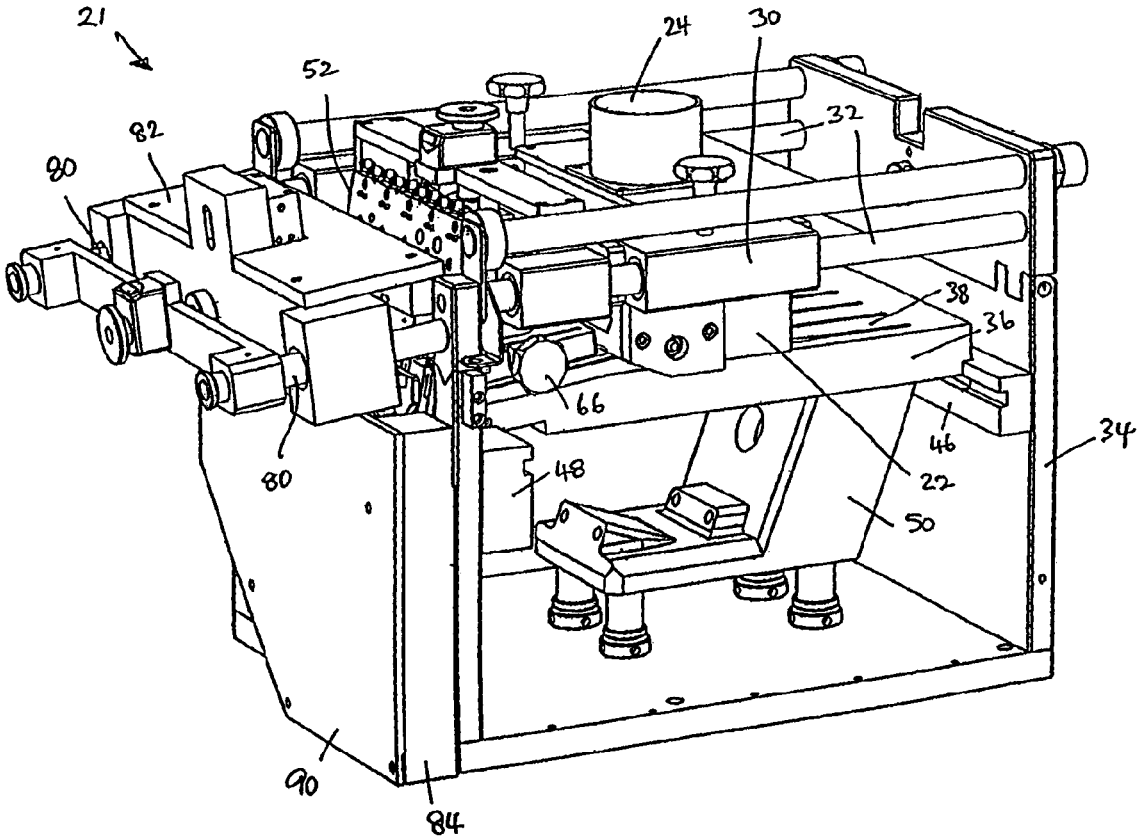
FIG. 6 is an isometric view of a second embodiment of a filling machine for filling discrete items of pharmaceutical product into patient packs.
Figure 7:
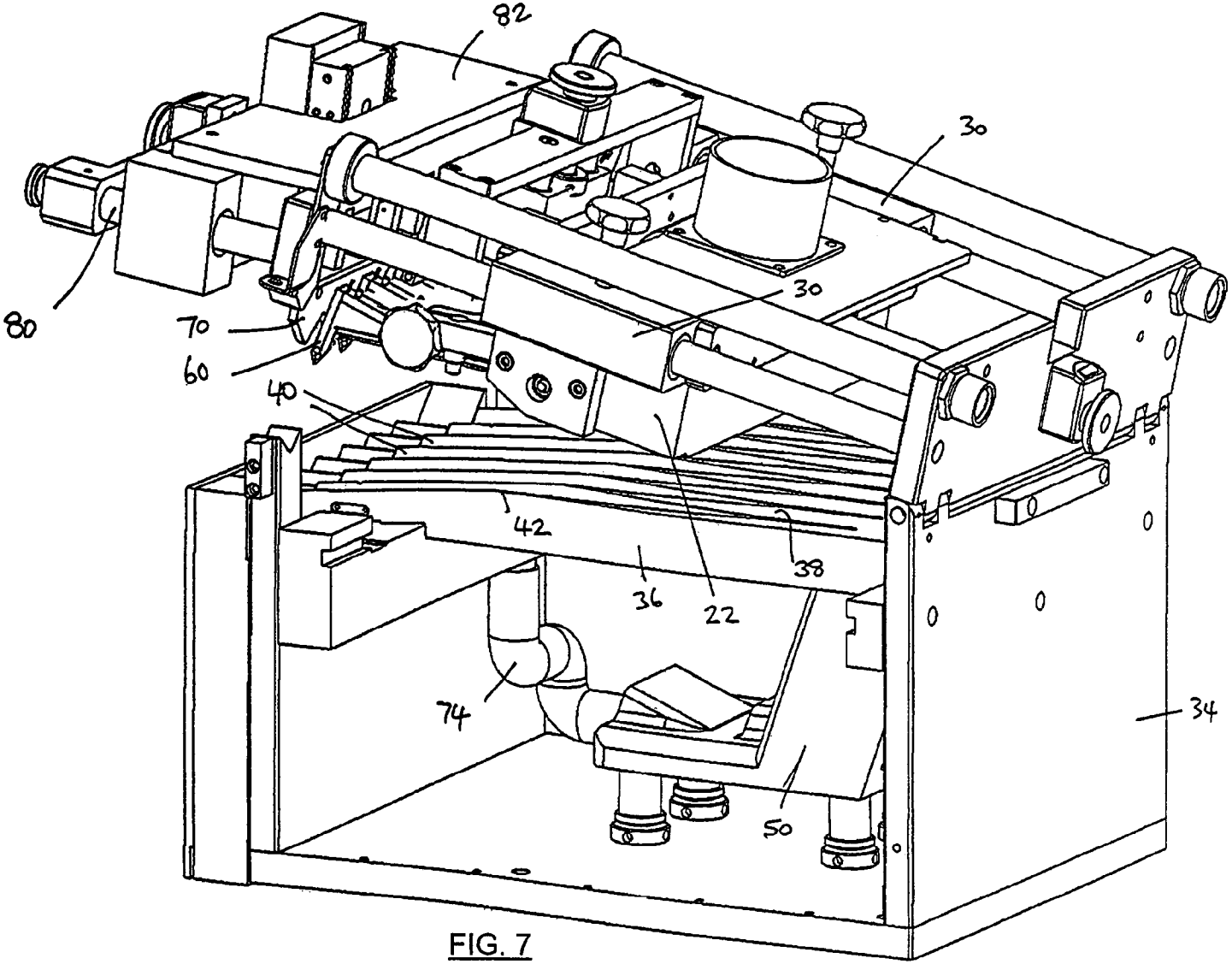
FIG. 7 is an isometric view of the filling machine of FIG. 6 from a different viewpoint and with the top partially lifted.

So as to enable accommodation of both large and small items, the restraining bars 9 are detachable from the actuating rods so that they can be interchanged with bars 9A having different lower surface profiles 9A. Examples of two preferred profiles are illustrated in FIGS. 5A and 5B. FIG. 5A illustrates a square bottomed bar 9 arranged to rest across the top of channel 5A. FIG. 5B illustrates a wedged or V-shaped profile so as to more closely correspond to the profile of the channel 5A. The first profile is thought to be more suitable for use with larger bevelled tablets 20 whereas the second profile is better suited to small items 21.

In a variation, not shown in the drawings, the hopper 2 may also comprise a baffle which extends from a mid-point of the front wall diagonally downwards towards the lower edge of the hopper's back wall so as to form a funnel to restrict and/or control the flow of product onto the tray. This inhibits jamming of the product and/or multiple simultaneous passage of product items through an aperture 2C. Further control of product in the vicinity of the funnel might be provided by a gating mechanism controlled by the control system, or by a sweeping mechanism as used in the second embodiment, to be described below.

The second embodiment of a filling machine is illustrated in FIGS. 6 to 15, and is broadly similar to the first embodiment, but incorporates a number of further variations, including neither of the gates being associated with a restraining bar but being formed separately and operating independently thereof. If there is no indication herein to the contrary, it may be taken that both embodiments incorporate similar features and operate similarly.

Referring initially to FIGS. 6 to 10 in particular, there is shown a filling machine 21 comprising a repository for discrete items of pharmaceutical product, formed of a container 22 with an upper charging inlet 24. The container 22 has an open bottom and a lower portion of its front wall is formed from a rubber strip member 26 secured by clamping screws 28. The container 22 is slideably supported via a container mounting carriage 30 on slide rails 32 which are in turn supported on a hinged upper portion of a frame 34.

A product feed tray 36 has a top surface 38 which defines seven parallel open-topped channels 40 running to a discharge end of the tray substantially along the length of the tray. In the channels 40 the surface of the tray has a V-shaped, including flat bottom V-shaped, cross section. The width and depth of each channel tapers gradually along its length from a nominal width and depth in a planar container base region of the top surface of the tray 36 to a maximum width and depth at point 42 where the planar portions of the surface terminate, as the tray slopes away, and is thereafter constant to an exit end of the tray from which product will, in use, be discharged. Throughout the channel's length, its width is greater than its depth so as to minimise jamming of items of product in the channel. The bottoms of the channels slope at a shallow angle of six degrees to the horizontal, downwardly towards the exit end.

The tray 36 is positioned such that the planar surface region is directly below the container 22 so as to form a base for the product repository. The tray 36 is also orientated such that the channels 40 extend under the front wall 26 of the container forming seven substantially triangular or trapezoidal apertures 44 (visible in FIGS. 11A, 11B) defined between the channel surfaces and the bottom edge of the front wall 26. The tray 36 is supported at each end on a rear mounting 46 and a front mounting 48, comprising PTFE blocks, which allow limited movement of the tray from end to end, longitudinally of the channels, but substantially prevent vertical or lateral motion of the tray. The tray is agitated, in use, by an electromagnetic shaker 50, of a kind known as a vibrating means in the blister pack filling art. The shaker 50 is itself mounted on frame 34.

Figure 11A:
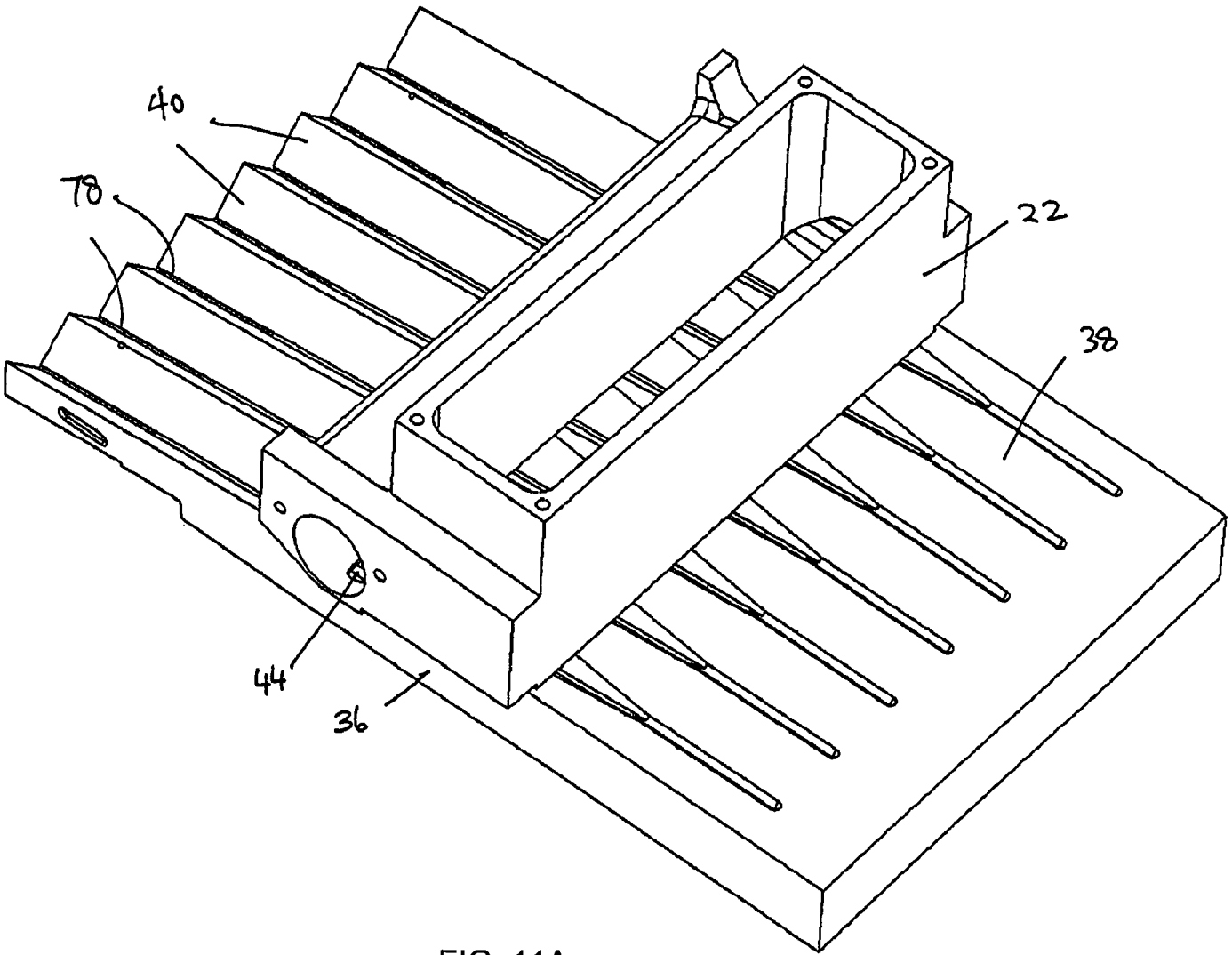
FIGS. 11A and 11B are isometric views to illustrate movement of the repository across the surface to adjust the aperture size.
Figure 11B:
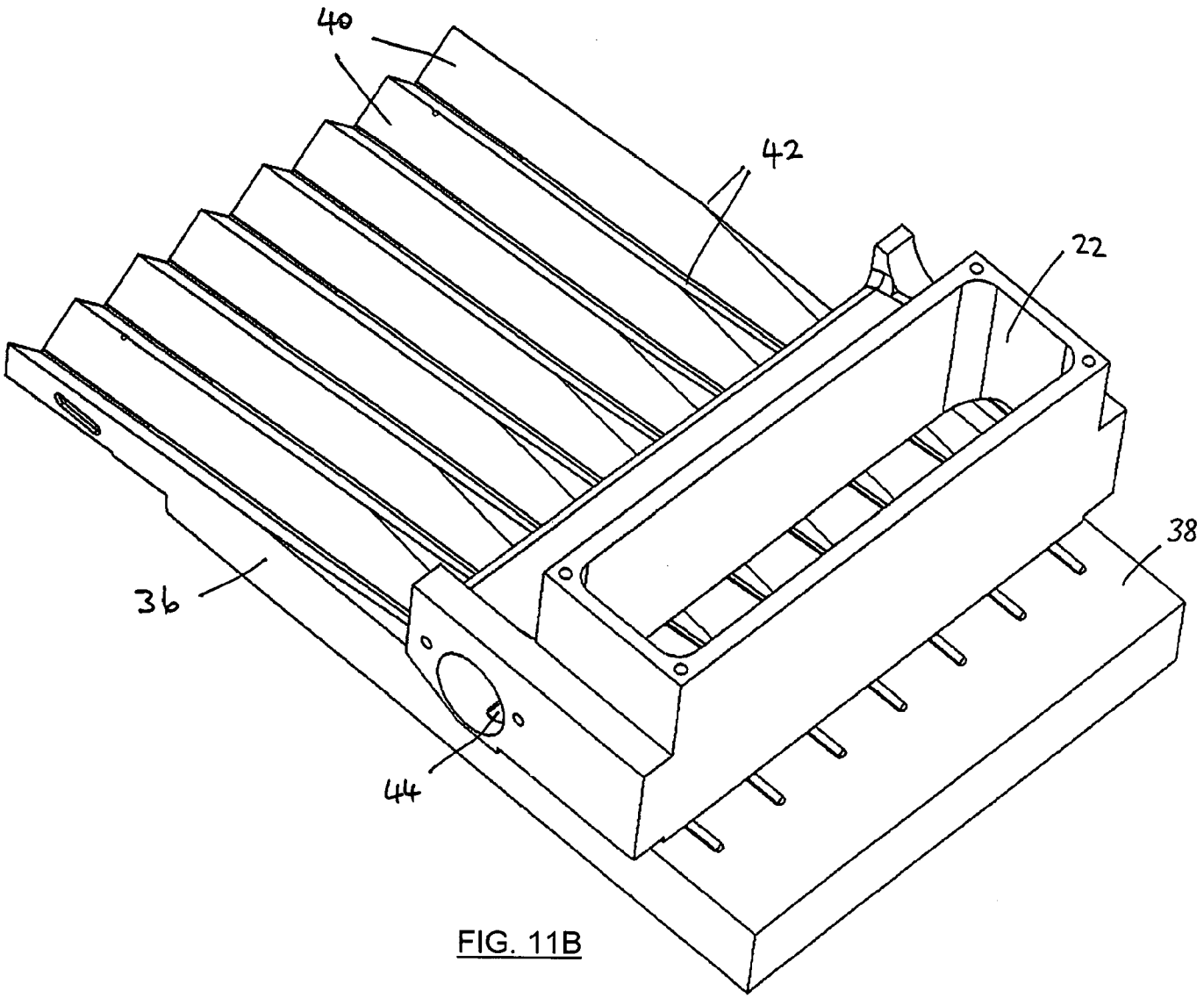

As can be seen in FIGS. 11A and 11B, the container mounting carriage 30 enables the container 22 to be slid along slide rails 32, horizontally across the top surface 38 of the tray 5, in the direction in which the channels 40 extend. Movement of the container towards the discharge end of the tray causes the size of each aperture 44 to increase as a consequence of the enlarging width and depth of each channel. Conversely, movement away from the discharge end of the tray causes a reduction in the aperture size. Movement of this kind allows the apertures to be sized depending upon the product held within the repository, such as to allow only a single item of product to pass out of each aperture of the hopper at a time, according to the product item dimensions.

Also mounted on slide rails 32, over the channels outside the container 22 in front of wall 26, is a product delivery compartment inlet gate mechanism comprising seven pneumatic cylinders (not individually shown) on inlet gate cylinder mount 52. Mounted in front of the container 22 is a restraining plate 54, the under side of which is shaped with seven integral restraining bars 56, one corresponding to each channel. The restraining bars 56 are positioned directly above the centreline of each channel and parallel to the sloping channel floor. The rear end of the plate 54 is tapered to closely abut container wall 26 above the apertures. At the front end of plate 54, remote from the container 22, are mounted seven delivery compartment inlet gates 60 comprising pivoted arms 62 tipped with triangular or trapezoidal gate pads 64, shaped to fit the channel profile and close the channel when the gate is lowered into the channel, and to open the channel when the gate arm is raised. The gate pads are made of a pharmaceutically acceptable material that will not damage product items in the channels. Silicone rubber is one such preferred material. Each gate 60 may be raised or lowered independently of the other six gates 60.

Because the restraining plate and inlet gates as well as the container are effectively mounted on the same carriage 30, all can be moved across the tray 36 whilst maintaining a consistent mutual position relationship. But since the channel floors are consistently sloping from the interior of the container to the discharge end of the tray, provision for tray (and therefore also inlet gate) height adjustment is made in the form of restraining plate clamps 66.

Figure 8:
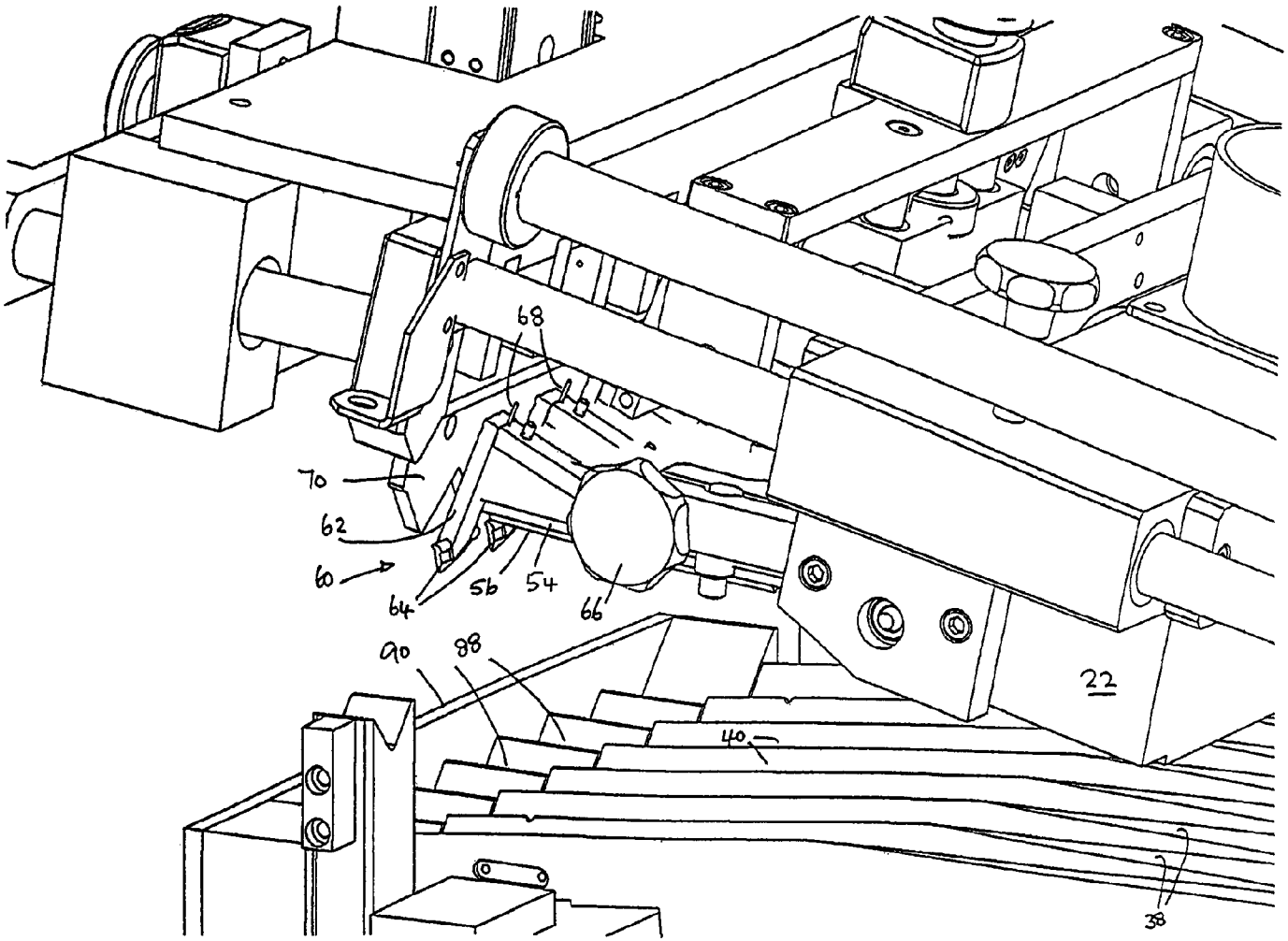
FIG. 8 is an enlarged view of a portion of FIG. 7.
Figure 9:
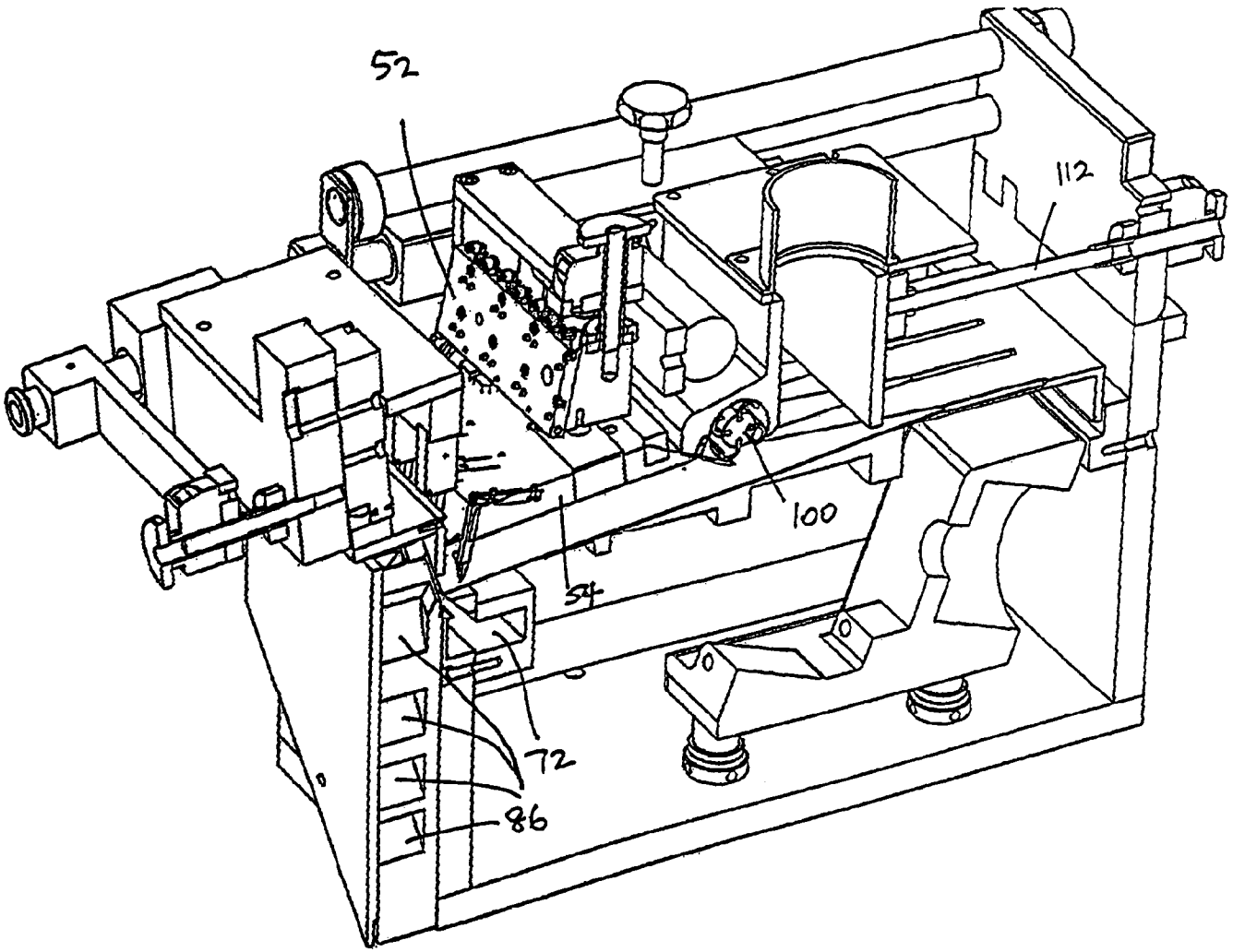
FIG. 9 is a view corresponding to FIG. 6 but in longitudinal cross section.
Figure 10:
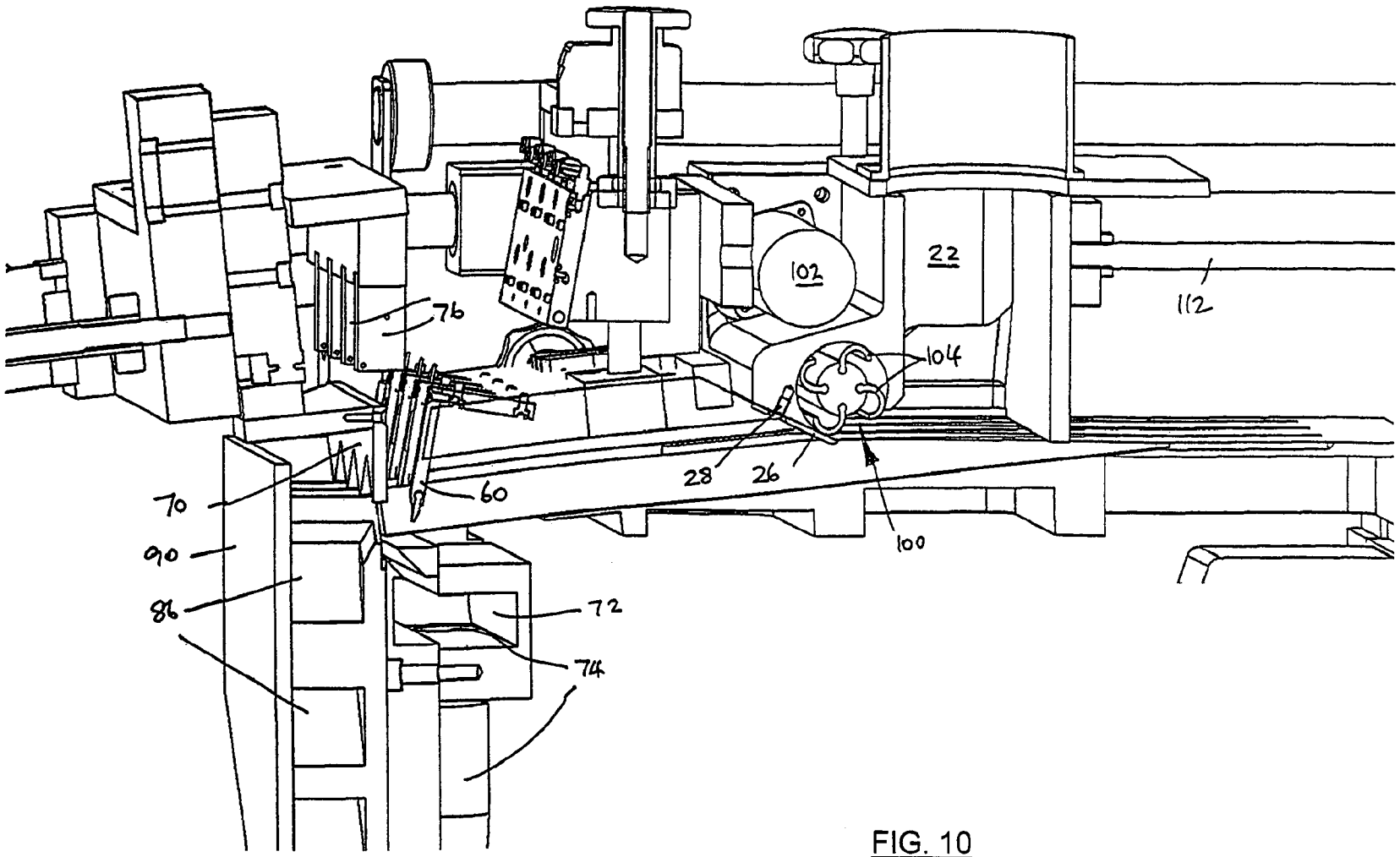
FIG. 10 is an enlarged view of a portion of FIG. 9.

Each discharge compartment inlet gate arm 62 also incorporates an air pipe 68 whose inlet is seen in FIG. 8. Each pipe passes through the arm and emerges directed downwardly on the front of the arm, directed into the channel. These air pipes are arranged to deliver air jets into the delivery compartment when the compartment discharge gate 70 is opened to discharge product. The air jets assist the discharge of the product, and in keeping the channel free of product dust. Below the discharge end of tray 36 is a dust extractor duct 72, connected to a vacuum duct 74 inside the frame 34 for collecting and removing such dust.

A further pair of slide rails 80, parallel with the alignment of the channel floors, support a discharge gate carriage 82 on which is mounted a laser sensor (not shown) mounted on plates 76, associated with each channel, as well as the single discharge gate 70 which is shaped to enter and close each channel at the same time, and a pneumatic operating cylinder (not shown) for the discharge gate.

The laser sensors are arranged to detect the presence of an item between the gates 60 and 70. Each sensor has a complementary reflector which is formed from a polished base portion 78 of the V-shaped channel. The polished portion extends over the possible length and position of the product discharge compartment. The sensors and pneumatic actuators are controlled by a programmable logic control system also not shown.

Figure 15:
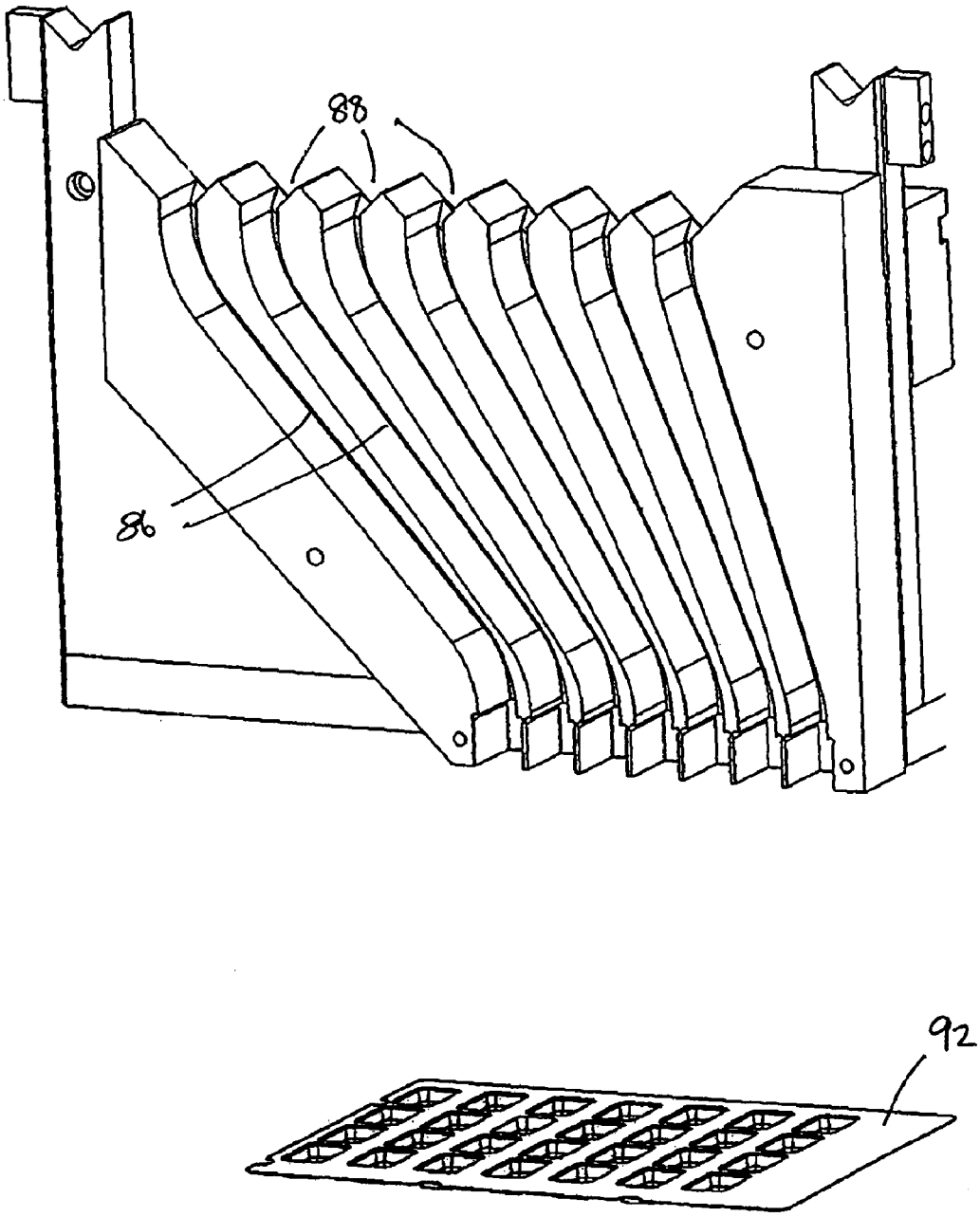
FIG. 15 is an isometric view showing a delivery chute, with its cover removed, leading from the machine to a blister pack.

Supported by the frame at the discharge end of the tray 36 is a vertical delivery box 84 containing seven individual chutes 86 whose inlets 88 are aligned with each of the channels 40. A transparent cover plate 90 on the front of the delivery box allows the chutes to be inspected. The lower end of the delivery box is the discharge outlet of all seven chutes, and flexible ducts may be provided, as known in the art, to lead discharged products into their proper pockets in a patient blister pack 92 (FIG. 15).

Inside the container 22, adjacent the front wall 26, is mounted a rotary sweeper 100, driven by electric motor 102. The sweeper has four stiff nylon blades 104 which continuously wipe the top planar surface of tray 36 inside the container above the outlet apertures 44, sweeping away product from the planar surface so preventing build-up of product items at this point and facilitating a steady delivery of single product items along the channels through the apertures.

Before operation, a suitable restraining plate 54 is selected, with its restraining bars 56 adapted to the product item. We have found that six different plates 54 may permit the machine to be used with up to 120 different shapes and sizes of pharmaceutical product, no other change parts being required at all. Such plates may be of the general form shown in FIGS. 12A and 12B, for tablets and caplets which have a flat or rounded face which causes the item to have a preferred way of lying against a flat surface (item 106, FIG. 12A), or of the form shown in FIG. 14 (a similar form to that of restraining bar 9 shown in FIG. 5B) for items that are round or rounded such that they have no preferred face to lie on. Each of these two general forms may be made to accept and restrain a range of item sizes in the channels 40.

Figure 12A:
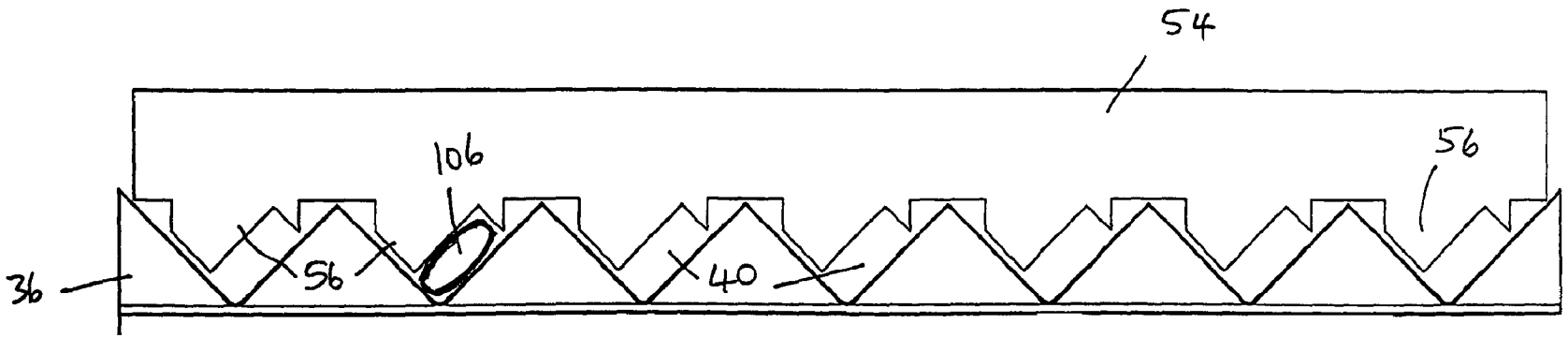
FIGS. 12A and 12B are respectively an end elevation and an isometric view illustrating the co-operation of a restraining member with channels formed in the surface of a delivery tray.
Figure 12B:
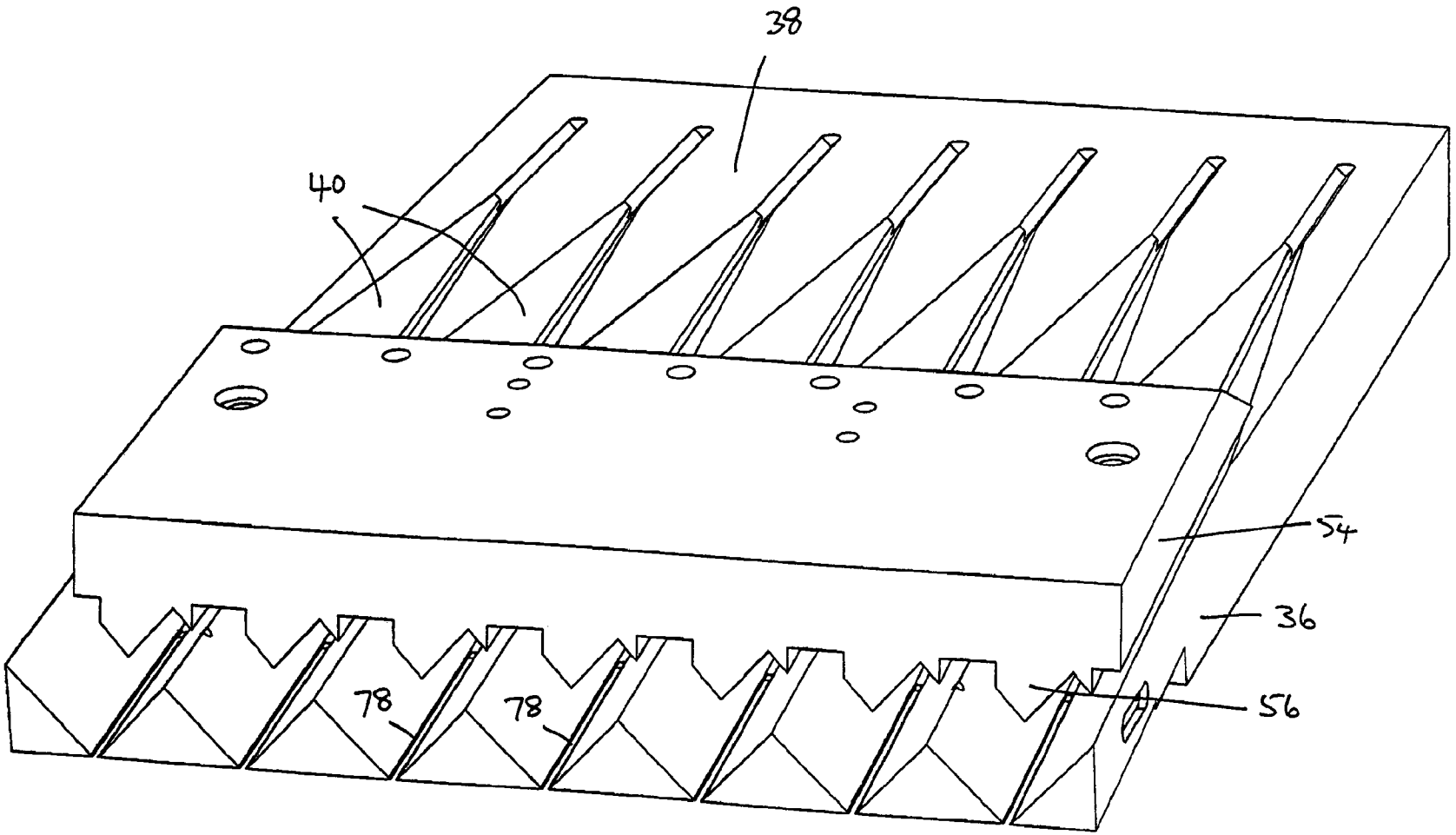
Figure 13:
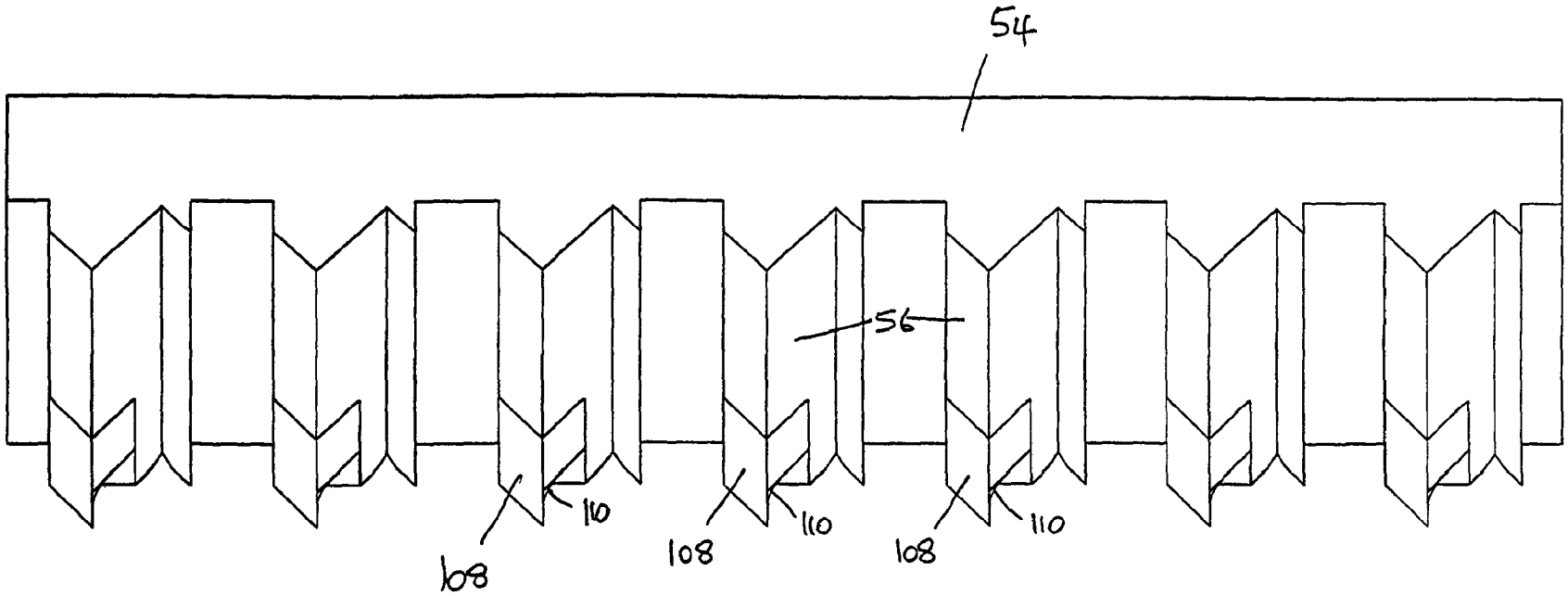
FIG. 13 is an isometric view from the exit end and underneath of the underside of the delivery tray of FIGS. 12A and 12B.
Figure 14:
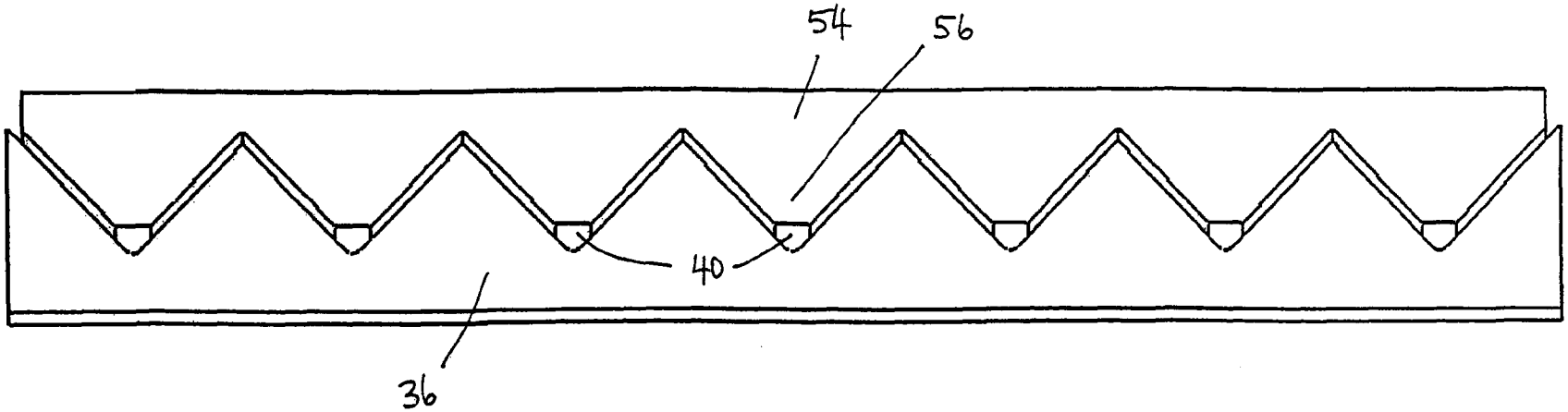
FIG. 14 is an elevation corresponding to FIG. 12A showing an alternative delivery tray for a different size and shape of product item.

FIG. 13 shows the restraining bars 56 of a plate 54 for tablets or caplets with preferred orientations. These bars are provided with entry guides 108 at the inlet ends, just outside apertures 44. Guides 108 have twisted guide surfaces 110 which do not interact with items lying in the channels as shown in FIG. 12A, but engage with, and turn into that orientation, items which are progressing along the channels resting against the opposite wall of the V. This ensures that all product items are aligned, and minimises jams.

Next, the carriage 30 is moved along slide rails 32 so as to tailor the aperture size 44 to the size of the product item. This may be done with lead screw 112. The height of the restraining plate and inlet gates above the tray may also be adjusted. The position of the discharge gate is adjusted to form the correct size of delivery compartment.

In use, the machine operates substantially as previously described in relation to the first embodiment of the invention.

It will be readily apparent to the skilled person that numerous variations can be made without departing from the invention. For example, in possible alternative embodiments, the channels may not be tapered but rather decrease in width and/or depth in a graduated manner; the aperture size may be adjusted by movement of the surface relative to the repository; the aperture size may be adjusted by vertical movement as opposed to solely horizontal movement; any suitable sensors other than laser sensors can be used, for example infrared sensors; and mechanical vibrators other than electromagnetic shakers can be used.

Further, the discharge gates need not be arranged to rest within the channel or profiled to suit but alternatively reside at the end of the channel. Additionally, means other than mechanical vibrators can be used to move the items through the aperture and along the channel.

While the invention has been described in detail and with reference to specific embodiments thereof, it will be apparent to one skilled in the art that various changes and modifications can be made therein without departing from the spirit and scope thereof.

The invention claimed is:

1. Product feeding apparatus for delivering items of product into one or more outlets for onward delivery to a receptacle, comprising:

a surface defining one or more channels having a length extending toward an exit end thereof for guiding items of product towards said exit end of said one or more channels and wherein the width and/or depth of one or more of said channels increases towards said exit end thereof;

a wall spaced from and adjacent to the surface;

wherein the wall and one or more channels cooperate to define at least one aperture through which items of product pass towards the exit of said one or more channels;

and wherein the size of the aperture is adjustable by movement of the wall and/or surface relative to the other in a direction along the length of said one or more channels.

2. Product feeding apparatus according to claim 1 wherein the wall is arranged to move transversely across the surface.

3. Product feeding apparatus according to claim 1 comprising a repository for holding loose items of product.

4. Product feeding apparatus according to claim 3 wherein the wall is associated with the repository.

5. Product feeding apparatus according to claim 3 wherein the wall forms part of the repository.

6. Product feeding apparatus according to claim 3 wherein the repository is slideably mounted above the surface.

7. Product feeding apparatus according to claim 3 wherein the repository comprises a baffle to limit/control the flow of product to the aperture(s).

8. Product feeding apparatus according to claim 1 wherein the channels are tapered.

9. Product feeding apparatus according to claim 1 having a vibrating means arranged to agitate the surface to shake items of product along the channel.

10. Product feeding apparatus according to claim 1 comprising a restraining means to inhibit movement out of the channel of items of product which have passed through the aperture.

11. Product feeding apparatus according to claim 10 wherein the restraining means is a restraining member supported above the channel.

12. Product feeding apparatus according to claim 11 wherein the restraining member is inclined at an angle to the surface.

13. Product feeding apparatus according to claim 1 having a gating mechanism to control the delivery of items of product into pockets of the blister.

14. Product feeding apparatus according to claim 11 wherein the gating mechanism comprises at least two gates; and optionally, wherein one of the gates is associated with the restraining member.

15. Product feeding apparatus according to claim 14 wherein the gate associated with the restraining member is formed as part of the restraining member and protrudes into the channel.

16. Product feeding apparatus according to claim 14 wherein the restraining member is moveable relative to the channel so as to actuate a gate.

17. Product feeding apparatus according to claim 13 wherein the gate mechanisms for associated channels are operable independently from one another.

18. Product feeding apparatus according to claim 1 having a repository, restraining means and gating mechanism which are supported on one or more carriages so as to be slideably movable across the surface.

19. Product feeding apparatus according to claim 18 wherein the gating mechanism comprises two gates which are on separate carriages so as to be independently movable from one another.

20. Product feeding apparatus according to claim 1 wherein the product is a pharmaceutical dosage form.

21. Product feeding apparatus according to claim 1 wherein the product is a pharmaceutical dosage form blister pack.

22. Product feeding apparatus according to claim 20 wherein the pharmaceutical dosage form is a tablet, caplet, capsule hardgel or softgel.

23. Product feeding apparatus according to claim 1 wherein the product is a patient pack.

24. Product feeding apparatus according to claim 1 wherein the channels are inclined downwardly from the repository towards the exit.

25. Product feeding apparatus according to claim 1 wherein the surface is moveable to shake items of product substantially only longitudinally of the channels.

26. Product feeding apparatus according to claim 1 wherein restraining means comprises a plurality of bars each configured to enter one channel and limit its effective size and shape.

27. Product feeding apparatus according to claim 26 wherein each bar comprises a channel entry guide.

28. Product feeding apparatus according to claim 27 wherein each channel entry guide comprises a twisted guide surface to turn a product item from one orientation to another.

29. Product feeding apparatus according to claim 1 wherein a pair of gates are arranged sequentially for each channel whereby to form a product item delivery compartment.

30. Product feeding apparatus according to claim 29 wherein the length of the compartment is adjustable for product size by adjusting the separation of the gates.

* * * * *